United States Patent [19]

Graser et al.

[11] Patent Number: 4,705,210

[45] Date of Patent: Nov. 10, 1987

[54] ELECTROMAGNETICALLY ACTUATABLE VALVE

[75] Inventors: Franz Graser, Bamberg; Werner Langer, Litzendorf; Reiner Nowak, Bamberg, all of Fed. Rep. of Germany

[73] Assignee: Robert Bosch GmbH, Stuttgart, Fed. Rep. of Germany

[21] Appl. No.: 11,402

[22] Filed: Feb. 4, 1987

Related U.S. Application Data

[63] Continuation of Ser. No. 810,632, Dec. 19, 1985, abandoned.

[30] Foreign Application Priority Data

Mar. 29, 1985 [DE] Fed. Rep. of Germany ..... 3511463

[51] Int. Cl.[4] ..... B05B 1/30; F02M 51/06

[52] U.S. Cl. ..... 239/585; 251/129.21

[58] Field of Search ..... 239/585; 251/129.01, 251/129.16, 129.22, 129.21

[56] References Cited

U.S. PATENT DOCUMENTS 3,383,084 5/1968 Mayfield ..... 251/129.16

4,390,130 6/1983 Linssen et al. ..... 251/129.16

FOREIGN PATENT DOCUMENTS 1291765 10/1972 United Kingdom ..... 251/129.16

*Primary Examiner*—Andres Kashnikow

*Assistant Examiner*—Michael J. Forman

*Attorney, Agent, or Firm*—Edwin E. Greigg

[57] ABSTRACT

An electromagnetically actuatable valve is proposed, which serves as a fuel injection valve for fuel injection systems in internal combustion engines. The valve includes a valve housing of ferromagnetic material, at least one magnetic coil mounted on a core of ferromagnetic material, and an armature arranged to actuate a valve closing element which cooperates with a valve seat. The armature protrudes beyond a ferromagnetic annular disk supported on a support shoulder of the valve housing and a stop disk of hard, nonmagnetic material is arranged in the annular groove of the annular disk such that when the armature is resting on the stop disk, a remnant air gap is formed in the axial direction between the annular disk and the armature.

5 Claims, 1 Drawing Figure

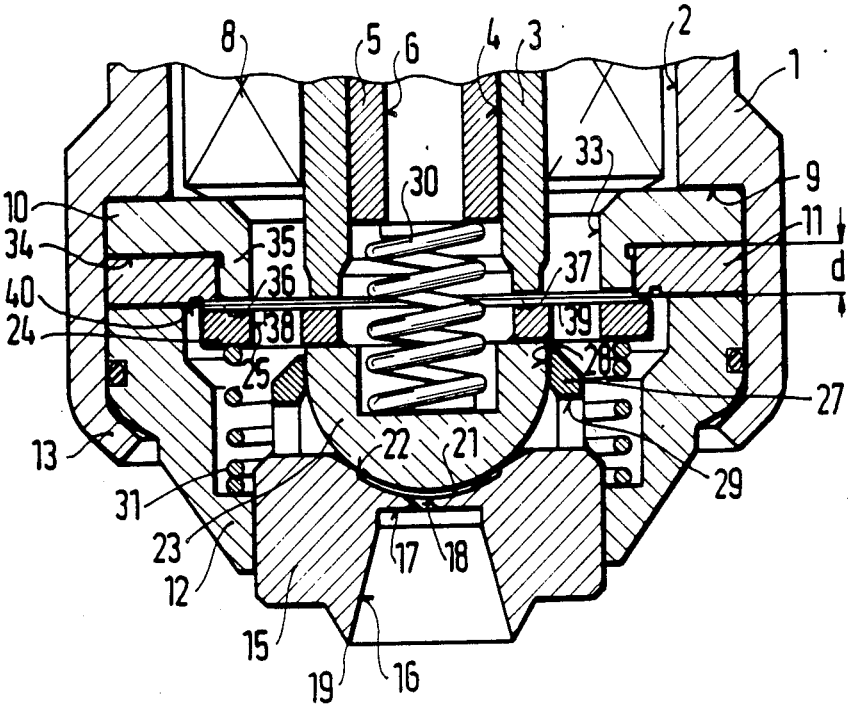
8
5
6
4
3
2
1
33
30
9
10
11
34
35
37
d
40
36
24
38
39
25
28
27
13
22
21
29
31
23
17
18
12
15
19
16

ELECTROMAGNETICALLY ACTUATABLE VALVE

This is a continuation of copending application Ser. No. 810,632 filed Dec. 19, 1985, now abandoned.

BACKGROUND OF THE INVENTION

The invention is based on an electromagnetically actuatable valve as generally defined hereinafter. A fuel injection valve for fuel injection systems is already known in which one end face of the armature protrudes beyond a ferromagnetic annular disk supported on the valve housing, and when the magnetic coil is excited the armature rests on this disk. The disadvantage in such a construction is magnetic adhesion, and if the surface of the intermediate disk is untreated the armature will gradually dent the disk; or if the disk surface is hardened, the magnetic conductance of the disk is impaired.

OBJECT AND SUMMARY OF THE INVENTION

The valve according to the invention and has the advantage over the prior art that since the annular disk no longer acts simultaneously as a stop, a material having optimal magnetic properties can be used for it, while for the stop disk acting solely as a stop, a nonmagnetic material of suitable hardness can be used.

In a further feature of the invention, the diameter of the armature and hence the armature mass can be kept as small as possible, which results in a fast-acting valve.

The invention will be better understood and further objects and advantages thereof will become more apparent from the ensuing detailed description of a preferred embodiment taken in conjunction with the drawing.

BRIEF DESCRIPTION OF THE DRAWING

The single cross sectional view of the drawing shows an exemplary embodiment of the invention in simplified form.

DESCRIPTION OF THE PREFERRED EMBODIMENT

The fuel injection valve for a fuel injection system shown in the drawing as an example of a valve is used to inject fuel into the intake tube of mixture-compressing internal combustion engines with externally supplied ignition and has a valve housing 1 of ferromagnetic material. A fuel connection pipe 3 embodied as a core of ferromagnetic material and having an inner bore 4 protrudes into a stepped inner housing bore 2 of the valve housing 1. An adjusting sleeve 5 having a through bore 6 is depressed or screwed into the inner bore 4. The end of the fuel connection pipe 3 protruding out of the valve housing 1 communicates with a source of fuel, for instance with a fuel pump via a fuel distributor line. A magnetic coil 8 is fitted onto the end of the fuel connection pipe 3 protruding into the inner housing bore 2 of the valve housing 1. An annular disk 10 of ferromagnetic material rests on a support shoulder 9 of the inner housing bore 2, and resting on this disk 10 are, in axial order, an annular stop disk 11 of hard nonagnetic material and a nozzle carrier 12. One end 13 of the valve housing 1 is crimped over partway about the nozzle carrier 12 and thus clamps the nozzle carrier 12, the stop disk 11 and the annular disk 10 in an axial direction against the stop shoulder 9. A nozzle body 15 is inserted into the nozzle carrier 12 and secured there, for instance by welding or soldering. The nozzle body 15 has a preparation bore 16, for instance frusto-conical in shape with the larger end at the outlet end. The nozzle body includes at least one fuel guide bore 18, which serves to meter fuel that discharges at the bottom 17 of the preparation bore 16. The fuel guide bores 18 discharges at the bottom 17 in such a way that no tangentially oriented inflow into the preparation bore 16 takes place; instead, the fuel stream initially emerges freely from the fuel guide bores 18 and subsequently strikes the wall of the preparation bore 16, so that it is distributed over the wall in the form of a film approximately parabolic in shape, and flows toward the ejection end 19 and is ultimately torn off. The fuel guide bores 18 are inclined with respect to the valve axis and they communicate with a spherical chamber 21 formed in the nozzle body 15. Upstream of the spherical chamber 21 in the nozzle body 15, a curved valve seat 22 is formed, with which a ball-shaped valve closing element 23 is arranged to cooperate. So that the idle volume will be as small as possible, the volume of the spherical chamber 21 should be as minimal as possible whenever the valve closing element 23 is resting on the valve seat 22.

Remote from the valve seat 22, the valve closing element 23 is connected to a disk-shaped flat armature 24, for instance by soldering or welding. Flowthrough openings 25 make it easier for the fuel to flow about the armature 24. Connected with the nozzle body 15 is a guide body 27, through the guide opening 28 of which the ball-like valve closing element 23 protrudes with slight play, and in which the valve closing element 23 and thus the armature 24 as well are guided in the radial direction when an axial movement takes place. Lateral openings 29 in the guide body 27 enable a flow of fuel to the valve seat 22. A closing spring 30 is supported on the adjusting sleeve 5 that is pressed or screwed into the fuel connection pipe 3; on its other end, the closing spring 30 engages the valve closing element 23 and urges it in the direction of the valve seat 22. Remote from the fuel connection pipe 3, the armature 24 is engaged by a pressure spring 31, which has a lesser force than the closing spring 30 and serves to effect faster opening of the valve when the magnetic coil 8 is excited.

The annular disk 10 is provided with a central through bore 33, into which one end of the fuel connection pipe 3 protrudes in the direction toward the armature 24; and has an annular groove 34 in which the stop disk 11 is seated. With a bent section 35, the annular disk 10 thus partly overlaps the stop disk 11 in the axial direction on its end oriented toward the fuel connection pipe 3. The stop disk 11 has a thickness d in the axial direction such that at its face 40 oriented toward the armature 24, the stop disk 11 protrudes axially out from the annular disk 10. Thus when the armature 24, which protrudes radially partway beyond the stop disk 11, rests on the stop disk 11, the armature forms respective first and second air gaps 38 and 39 with the end face 36 of the bent section 35 and with the end face 37 of the fuel connection pipe 3. Thus a magnetically high-quality material can be used for the annular disk 10, and a hard, non-magnetic material can be used for the stop disk 11, independently of each other, which not only reduces costs but also increases the functional reliability and speed of the valve.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. An electromagnetically actuatable valve for fuel injection systems in internal combustion engines, comprising a valve housing 1 of ferromagnetic material having a longitudinal axis and provided with fuel inlet means, at least one magnetic coil 8 mounted on a core 3 of ferromagnetic material disposed axially of said housing, an armature 24 in close proximity to a valve closing element 23 adapted to open and close a fuel outlet means associated with a valve seat 22 upon excitation of said magnetic coil, an annular disk 10 having a predetermined height disposed in said housing 1 relative to a stop shoulder 9, said annular disk further being provided with a collar 35 extending toward said armature and defining annular inner and outer walls, said annular inner wall defining a first diameter, said annular outer wall having a height and arranged to receive an annular stop disk 11 having an outward face portion 40, said annular stop disk 11 having a height "d" greater than said height of said annular outer wall, said annular stop disk 11 being arranged to extend beyond said annular outer wall upon being received thereby, said annular stop disc 11 then being adjacent to said armature, said annular stop disk 11 having means defining a central aperture, said central aperture defining a second diameter, said armature 24 having a diametrical extent greater than said first diameter of said annular disk 10 and greater than said second diameter of said annular stop disk 11, said outward face portion of said annular stop disk 11 serving as a stop for said armature upon excitation of said magnetic coil and movement of said armature axially to open said valve, the height of said annular stop disk 11 being greater than that of said annular outer wall of said collar prohibits said armature from touching said annular disk and said core, whereby a first remnant air gap 38 is defined between said annular disk and said armature and a second remnant air gap 39 is defined between said armature and said core.

2. An electromagnetically actuatable valve as defined by claim 1, further wherein said valve seat is provided on a nozzle body and said nozzle body includes an upstanding guide body through which said valve closing element passes.

3. An electromagnetically actuatable valve as defined by claim 2, further wherein said guide body further includes lateral openings which allow fuel to flow from within the valve to said valve seat for delivery through said fuel outlet means.

4. An electromagnetically actuatable valve for fuel injection systems in internal combustion engines as claimed in claim 1, further wherein said annular stop disk is comprised of a hard, nonmagnetic material.

5. An electromagnetically actuatable valve for fuel injection systems in internal combustion engines as claimed in claim 1, further wherein said core comprises a portion of a fuel connection pipe extending longitudinally within said valve housing.

* * * * *